United States Patent [19]

Merl

[11] 4,310,097

[45] Jan. 12, 1982

[54] GRAVITY FEED COMBINED DISPLAY AND STORAGE UNIT

[75] Inventor: Milton J. Merl, New City, N.Y.

[73] Assignee: Marlboro Marketing, Inc., New York, N.Y.

[21] Appl. No.: 175,558

[22] Filed: Aug. 5, 1980

[51] Int. Cl.[3] ..... A47F 1/00

[52] U.S. Cl. ..... 211/49 D; 211/74; 312/45

[58] Field of Search ..... 211/49 D, 94, 94.5, 211/162, 74; 312/45

[56] References Cited

U.S. PATENT DOCUMENTS

| | | | |
|---|---|---|---|
| 1,958,781 | 5/1934 | Beukema | 211/74 |
| 1,973,854 | 9/1934 | Hoffman et al. | 211/74 |
| 2,620,691 | 12/1952 | Gould | 211/74 X |
| 2,880,904 | 4/1959 | Linthicum | 211/74 X |
| 2,919,814 | 1/1960 | Berkowitz | 211/74 |
| 3,063,534 | 11/1962 | Amour | 211/49 D X |
| 4,022,363 | 5/1977 | Eliassen | 211/74 X |

*Primary Examiner*—Roy D. Frazier

*Attorney, Agent, or Firm*—Wolder, Gross & Yavner

[57] ABSTRACT

A gravity feed combined display and storage unit for use in a professional salon type environment. The unit is divided into a plurality of compartments separated by a series of bottle supports, T-shaped in configuration, which includes an upright divider member and outwardly depending shoulders. The supports slope dowwardly from the back to the front of the unit where they abut a plurality of bottle stops. The sides of the shoulders are spaced apart a sufficient distance, to support a bottle by the underside of its angle and neck feed, the bottle supports being positioned at a sufficient height so that the bottles hang free and clear from any base surface. The shoulders terminate a sufficient distance from the back wall to that bottles may be placed in the rear, the shoulders supporting a number of bottles.

The bottle stops terminate just below the shoulders and the bottle neck, exposing the entire front panel. The edge of adjacent stops form a channel whose width is less than the diameter of the bottle neck, with intermediate setbacks, then forming a channel whose width is greater than the width of the neck and the cap. The distance from the bottom of the stop to the setback is sufficiently less than the distance from the bottle shoulder to the neck feed, so that slightly elevating the bottle allows it to clear the stops and be removed. Gravity will cause the bottles in back of the removed bottles to slide forward, thus exposing the label of the next bottle in sequence.

6 Claims, 10 Drawing Figures

150
152
154
156
158
160
162
100
102
46
48
50
30
56
58
60
62
64
66
68
26
32
28
72
41
38
40
42
44
34
36
18
92
80
88
86
84
82
4
5

GRAVITY FEED COMBINED DISPLAY AND STORAGE UNIT

BACKGROUND OF THE INVENTION

The present invention relates to display and storage units, and more specifically to a gravity feed combined display and storage unit for use with merchandise to be easily inventoried and yet to have the merchandise displayed so the contents are readily identifiable.

It is known in the art to provide gravity trays in which base units are tilted downwardly from the rear towards the front so that merchandise positioned in the back will slide towards the front when something in the front has been removed. These trays all support merchandise at their base. It is also known in the art, to hang certain containers for goods, such as bottles by the neck. The support members are horizontal to any base so that the merchandise is flat, and if an item is removed, the rear items must be moved forward.

It has also been found that professional beauty salons have difficulties in properly storing and identifying certain of the products they must use, especially with respect to hair treatment solutions and hair coloring solutions. It is important that the contents of each of these bottles be easily identifiable, since they all tend to be of a standard configuration. Furthermore, it is desirable that these bottles be stored in such a manner that they may be rapidly made accessible to the employee of the salon.

OBJECTS AND ADVANTAGES AND BRIEF SUMMARY OF PRESENT INVENTIONS

Accordingly, it is among the principal objects of the present invention to provide gravity feed combined display and storage units.

Yet another object of the present invention is to provide a device of the character described which will allows easy storage of merchandise while displaying the complete label carried by the product container.

Still yet another object of the present invention, is to provide a combined unit in which inventory of various products may be easily stored in quantity.

Still yet another object of the present invention, is to provide a gravity feed unit in which the inventory may be loaded in the rear and stacked, so that as the unit is removed from the front, the stored members automatically proceed downwardly and the subsequent unit is then fully available for label scrutiny.

Still yet another object of the present invention, is to provide a device of the character described which will allow easy and simple loading of merchandise, and will allow easy removal of displayed merchandise.

Still yet another object of the present invention, is the provision of a safety receptacle in the rear of the unit to prevent a bottle from falling in an inaccessible location of the unit.

Still yet a further object of the present invention, is to provide a device of the character described in which there is a support receptacle to retain those bottles or product containers in which only a portion of the contents is used, thus providing a logical storage place for the unit until the remainder of the solution is used.

Still yet a further object of the present invention, is to provide a combined display and storage unit which will be simple and economical to manufacture, will result in a highly organized and efficient storage and display unit, and yet will be practical to a high degree in use.

In accordance with the present invention, there is provided a gravity feed combined display and storage unit, which consist in its initial embodiment of a single compartment having two oppositely disposed bottle supports secured to the upper back posts of the unit and then slanting forwardly towards the front where they terminate against a bottle stop. A bottle is introduced through the rear and is secured on the upper portion of the supports. The supports are high enough so that the bottle may slide forward by gravity without touching the base of the unit until it hits the bottle support. The support is of a height which is slightly less than the distance of the thin portion of the neck to the top of the cap. Therefore, when the bottle is lifted upwardly against the stop, it can clear the upper wall of the bottle stop as well as the lower wall of the bottle support, and thus can be removed from the unit.

Because of the ability of the bottle to clear the upper wall of the bottle stop, it is also possible to front load the unit if the rear is inaccessable, either due to top stacking of a second unit or placement on a shelf area where there is no room in the back, therefore preventing access.

In its preferred embodiment the unit consists of a series of compartments divided by a series of bottle supports. The supports are secured to the upper back panel of the unit and then slant forwardly towards the front of the unit where they abut terminated against a series of bottle stops. The supports consist of a series of outwardly depending shoulders which are spaced from each other a distance sufficient to form a channel which is just slightly larger than the diameter of the neck of the bottle. The shoulders terminate short of the back panel so that the bottles may be dropped and positioned on the shoulders. The bottle then will slide forwardly on the shoulders until it reaches the bottle stops. Obviously, the bottle supports are placed high enough on the unit so that at all times the bottle will be hanging free and clear, above any support surfaces.

The side edges of the stops form a continuation of the channel defined by the side edges of the shoulders, except that the stops extend now from an acute angle which is generally perpendicular to the support surface. This stop portion of the channel only extends for a short distance after which there is a setback, and a continuation of the channel at a wider width, the second width being at least slightly longer then the widest diameter of the bottle neck or the bottle, or the bottle cap. The length of the lesser width channel formed by the stops is somewhat shorter than that of the length of the bottle neck, so that by slightly elevating the forwardmost bottle, the enlarged portion of the neck or the cap will clear the second wider channel and the bottle may be easily removed from the behind stops. Because of the gravity feed, all the bottles in line behind the removed bottle will slide forwardly until the next bottle in line abuts the stops.

Below and forwardly of the bottle stops and on the base of the unit are a series of receptacles designed to accommodate the base of the bottle. There are occasions when only a portion of the solution within a bottle is used, and this is an obvious and efficient place to put the bottle containing the unused portion until there is further need of it.

Furthermore, underneath the ingress to the shoulders and the back upper portion of the unit, there is a catch shelf that will retain a bottle, should it fall. This will prevent the bottle from being inconveniently positioned within the unit. The catch will allow someone to easily grasp the bottle again and place it in the proper position on the shoulders.

DESCRIPTION OF DRAWINGS

Other objects and advantages of the present invention will become apparent from a reading of the accompanying description and drawings.

DETAILED DESCRIPTION OF THE PREFERRED EMBODIMENT

Figure 1:
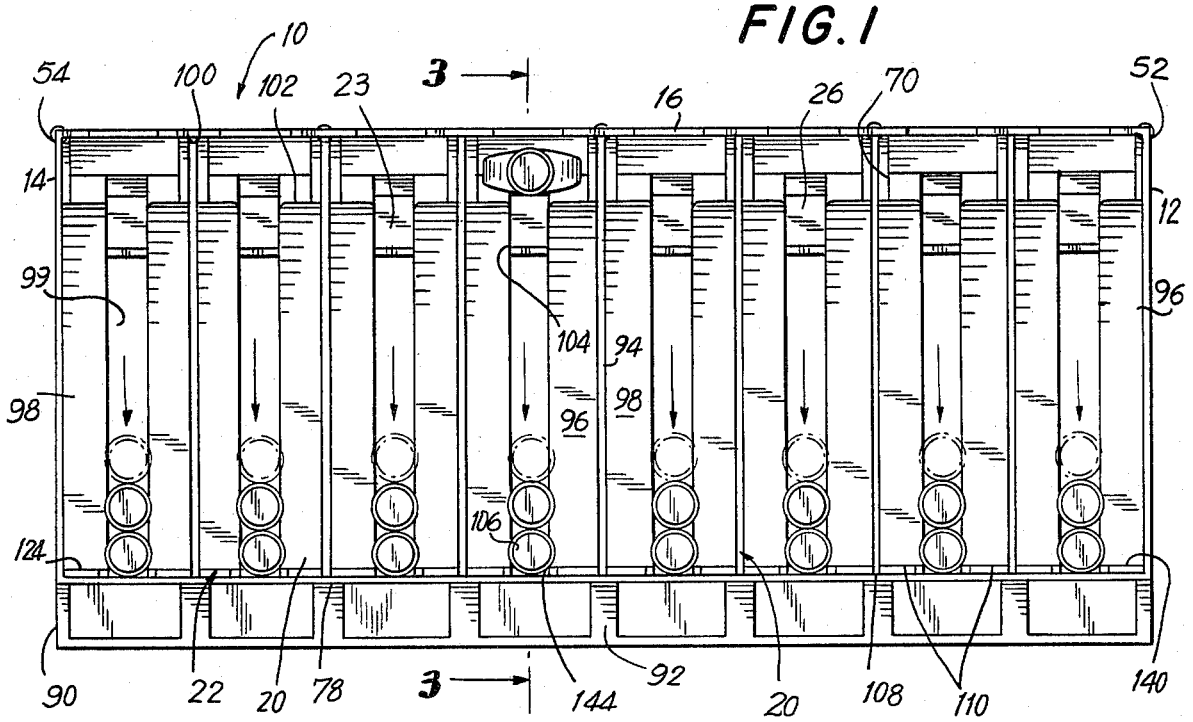
FIG. 1 is a planned view of a preferred embodiment of a gravity feed combined display and storage unit embodying the present invention.

Turning to the drawings and more specifically to FIGS. 1–5, there is shown a preferred embodiment of the invention disclosing a gravity feed combined display and storage unit 10 broadly comprising a right side wall 12, a left side wall 14, a back wall 16, a lower front step wall 18, bottle supports 20 terminating in bottle stops 22, forming compartments 23. The unit is bound in the front by a upper front display panel 24, and has disposed in the rear a bottle catch member 26.

Figures 3, 4, 5:
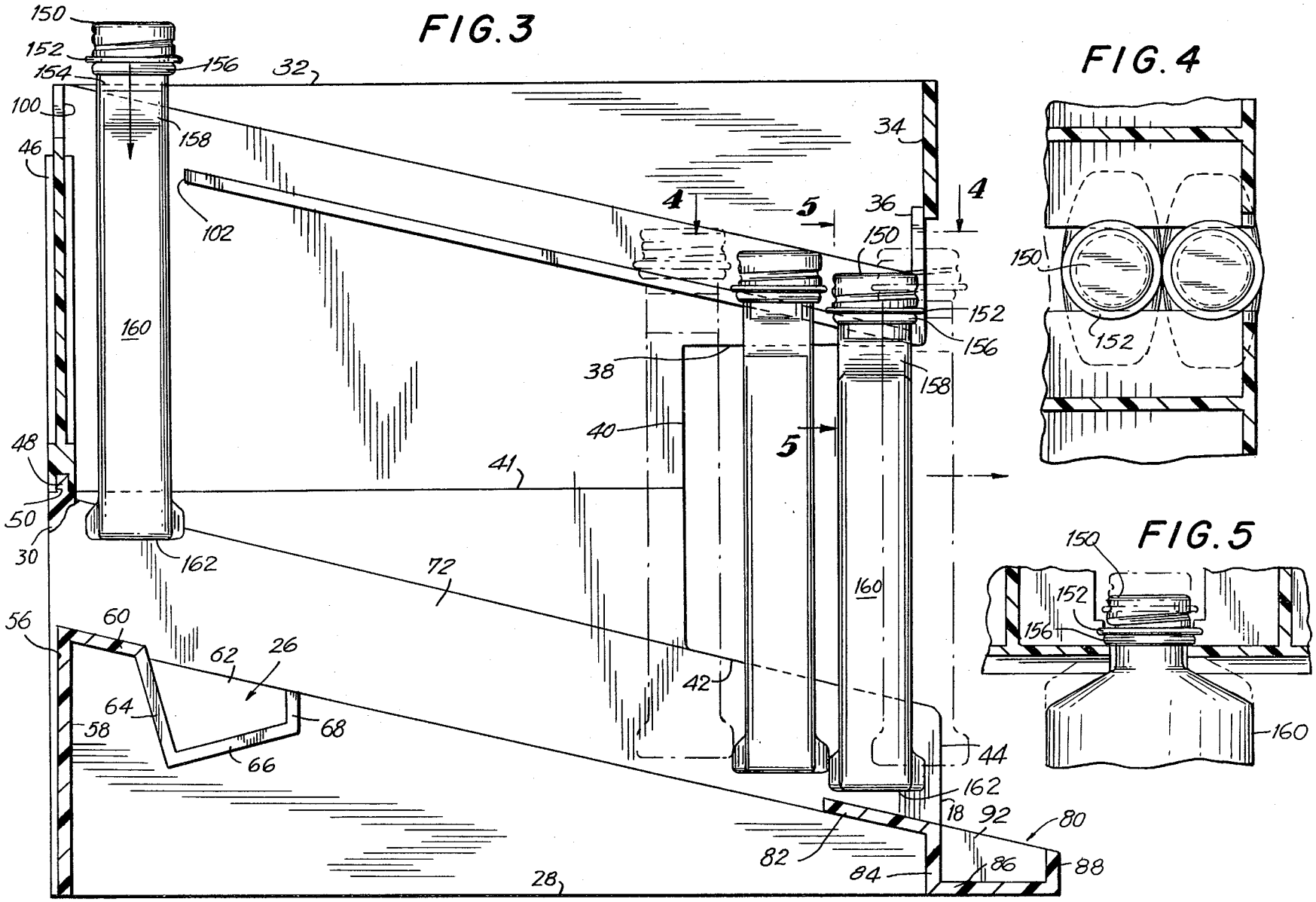
FIG. 3 is an enlarged cross-sectional view taken along the line 3—3 of FIG. 1.
FIG. 4 is a further enlarged cross-sectional, fragmentary view taken along the line 4—4 of FIG. 3.
FIG. 5 is a further enlarged, cross-sectional, fragmentary view taken along the line 5—5 of FIG. 3.

Turning to the right side wall 12, as best seen in FIG. 3, the wall is defined by a bottom edge 28, a back edge 30, a top edge 32, an upper front edge 34, and an upper front inner surface 36. At the lower terminating point of the edge 34, is a horizontal set-back shoulder edge 38 from which depends a middle, recessed front edge 40 passing through the joint or crease 41 of the upper and lower sections of the unit, as hereandafter discussed. The unit terminates at a lower forwardly slanting edge 42 which terminates at a lower front edge 44, ultimately joining the bottom edge 28.

It is obvious that left side wall 14 is essentially mirror-symmetrical with the right side wall 12 and need not be discussed further other than to note that these same parts will carry the same reference numbers. Furthermore, the upper and lower sections may be secured to one another by means of cylindrical posts, pins, and mating blind holes into which the pins are placed.

This is more specifically illustrated in reference to the back wall 16 in which there are shown a series of cylindrical posts 46 carrying pins 48 received within holes 50 in the well known manner. The wall is defined by right side edge 52 and a left side edge 54. Furthermore, it has a lower inner surface 56 (FIG. 3) to which is secured a plurality of bottle catch members 26.

The member 26 includes a vertical back flange 58 having a width sufficient to define the width of the compartments 23. Depending downwardly and forwardly from the top of the flange 58 is a sloping wall 60 which terminates at the catch basin 62 formed from a rear sloping wall 64, and upward sloping wall 66, and terminating in a forward substantially upright wall 68. The whole unit is defined by side edges 70.

Figure 2:
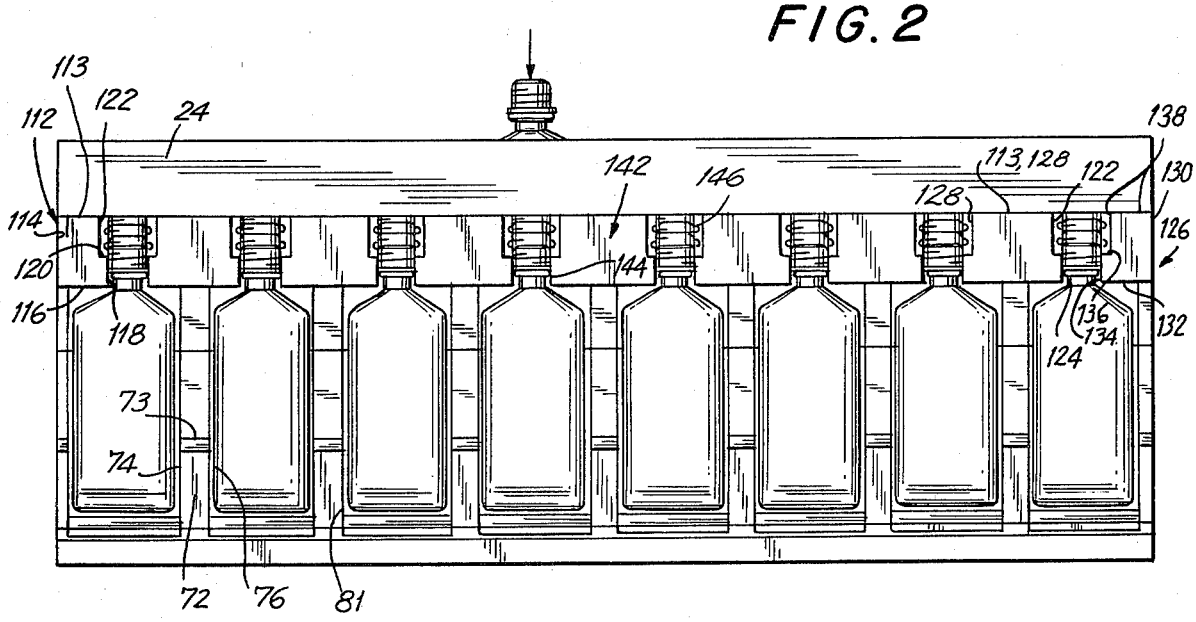
FIG. 2 is a front elevational view of FIG. 1, and showing a bottle about to be positioned in one of the compartments.

Interposed between the bottle catch members 26 are a series of lower upright divider members 72 (FIG. 2). These members abut against the catch members and extend forwardly on both sides. The member is defined by an upper surface 73 and side walls 74, 76, portions of which abut the edges 70. The upper and lower sections may be secured by means of appropriate posting pins, as previously described for the back inside walls (not shown).

The member 72 terminates in a front step wall 18 as previously described and defined by front vertical surface 78. As best seen in FIG. 3, there is secured to the member 72 a storage receptacle member 80. This unit is secured at its side edges 81 along its rear sloping wall 82. Depending downwardly from wall 82 is a rear wall 84, a lower horizontal wall 86, and a front wall 88, the walls 84, 86, 88 forming a storage receptacle for the purpose hereandafter appearing. The receptacle is further defined by outer side walls 90 and intermediate side walls 92.

Turning now to the essence of the invention, there is secured at the upper portion of the unit, a series of bottle supports 20. The supports are essentially T-shaped in cross-sectional configuration and slope downwardly from the rear towards the front of the unit. At all times, the units are of a sufficient height above the bottom edge 28 and the walls 60, 82, so that units hang free and clear resting upon these bottle supports only. More specifically, the preferred embodiment is designed to accomodate a two fluid ounce bottle of Clairol hair coloring formula generally used only by professionals, but other non-professional two ounce sizes may also be used.

The intermediate support is essentially T-shaped in configuration and includes an upper upright divider member 94, which is the upstanding leg of the T, and left and right sloping shoulders 96, 98. The shoulders slope from the rear towards the front in a downwardly direction.

It should also be noted that on the surfaces of the left and right side walls 12, 14, there are secured right and left shoulders 96, 98 respectively.

The important feature of the shoulders is that opposite shoulders match off and are spaced from each other, forming channels 99.

The member 94 terminates at a back edge 100 which abuts the inner surface of the back panel or wall 16. The shoulders end in back edges 102, which are spaced from the back wall 16. The shoulders have an engagement surface 104 which is essentially a thin strip near the side edge of the channel of the shoulder. It is on this edge that the bottle cap or the neck of the bottle rests and is supported, as will hereandafter appear. It is also within the scope of this invention for this surface to be slightly concave so as to better accommodate a bottle cap or a bead on a bottle neck. At the forward most portion of the shoulders, there may be an additional recess formed in the inner edges of the shoulders and extending slightly toward the member 94 so as to form a well and so as to accommodate the cap or bead of the forwardmost bottle.

The forward edge 108 of member 94 abuts the inner and upper surface of the stop members and the forward edges 110 of the shoulders stop just short of the stop members.

Turning in detail to the stop members 22, they consist of three different members. The first is a left end strip 112 defined by a top edge 113, a left edge 114, a bottom edge 116, a lower right side edge 118, an intermediate shoulder 120, and an upper right side edge 122. The unit also has a rear surface 124.

In a similar fashion mirror-symmetrical right side stop 126 is defined by a top edge 128, a right edge 130, a bottom edge 132, a lower left side edge 134, an intermediate shoulder 136, and a upper left side edge 138. Furthermore, the unit is defined in the rear by a rear surface 140.

Finally, in between the left and right stops are a series of intermediate stops 142, having essentially the same configuration as these two units joined at their edges 130, 114. Other than these two numbers, the appropriate surfaces of these stops will carry the same reference numbers as the separate stops. The lower edges 118, 124, form a first or stop channel 144, which is the same width as channel 99. Since this channel is less than the widest diameter of either the cap or the beak portion of the neck, the bottle cannot travel any further through the stop.

The edges 122, 128, form a second channel whose width is wider than the widest portion of the neck and/or the beak portion of the bottle.

Secured to the leading edges of the walls 12, 14, in the upper front edges of the stops, is the front display panel 24 which may carry any desired type of indicia, or they may be used to rigidify the frame of the unit.

With respect to the operation of the unit, the present invention is designed to accommodate the standard Clairol, Inc. two fluid ounces bottle containing their hair coloring product. This bottle consists of a cap 150 having a lower lip 152, a neck 154 having a annular bead 156 upon which the lower tip of the cap rests. Depending downwardly from the neck, are shoulders 158 and a body 160 terminating in a bottom ege 162. When it is desired to load the unit, the bottle is placed into position (FIG. 3) by passing it through the open top of the unit and into one of the compartments 23. The bottle is able to pass directly toward the bottom of the unit because the shoulders terminate at back edges 102. Furthermore, the width of the compartment is sufficient to accommodate the width of the particular bottle in question. When the bottle is within the unit, the user places the bottle on the shoulders 96, 98, with lower portion of the bead 156 resting on engagement surfaces 104 of the shoulders, as illustrated in FIG. 1. In FIG. 2, the bottle is shown in a position similar to FIG. 3, being placed in position within one of the compartments, the top view of this being shown in FIG. 1. The bottle is then released from the grip of the person placing the bottle in position as can be seen in FIG. 3, the bottom 162 clears the lower walls 60, 82, so that gravity will cause the bottle to move forwardly in position down the shoulder, always hanging free and clear of any lower obstruction. Obviously, the width of channel 99 is such that the lower edges of the beads will just rest upon the engagement surfaces 104 of the channels. There is shown in the preferred embodiment a plurality of compartments so that a plurality of different hair colors may be positioned and stored within the unit.

The first unit in a particular compartment will slide all the way forward to the front, where it will meet the stop members 112, 126, 142. Since the first or stop channel 144 is the same width as the channel 99, when the bead reaches this lowest most point, its further downward movement is stopped. At this position, the bottle may be turned so that the label is fully viewable to persons facing the unit. Therefore, an operator in a beauty salon desiring a particular color need only look at the first bottle to select the color that is desired.

The height of the lower side edges 118, 124, is less than the height of the neck of the bottle from the top of the shoulders to the bottom of the annular bead. Therefore, when the bottle is lifted slightly upwardly, the bead clears the intermediate shoulders 120, 126, with the shoulders 158 of the bottle just below the bottom edges 116, 132 of the stop members, and the bottle may be then pulled forwardly and removed from the unit. Because of the gravity feed and the forces of the bottles in the rear, all the remaining bottles will move forwardly and downwardly with the next bottle assuming a position of the previously removed bottle.

When the bottle is initially placed within the unit to fill in the empty volume in the rear of the unit, a bottle may be accidentally dropped into the unit. In order to facilitate its removal and proper placement on the shoulders, the unit is provided with a bottle catch member 26. Should the bottle be dropped, the base 162 will hit the sloping wall 60 and thence the wall 64 and be retained within the catch basin 62. The bottle will be in a high enough position within the unit so that the individual's hands may be placed down between the shoulders and pick the cap of the bottle up and place it upon the shoulders properly.

Sometimes an employee of the salon may use less than a whole bottle of hair coloring or may mix several bottles leaving solutions in several half filled bottles. In this case, the unit is provided with a series of storage receptacle members 80. The receptacles defined by the walls 84, 86, 88, 90, 92, are sufficient to comfortably accommodate these bottles, and other users can see what partially filled bottles are available containing what solutions. This provides for more efficient use of these open bottles, without the necessity of users going from station to station to look for empty bottles.

Turning to FIGS. 6–10, there is shown an alternate embodiment of the present invention. This embodiment discloses the use of a slightly different bottle top (for illustrive purposes only) in which the shoulders engage the cap of the bottle, rather than an annular bead on the neck. In this embodiment, like parts will be identified with like numbers, except that numbers will commence with the prefix numeral "2" or in the case of those numerals which are above 100, the prefix numeral "3".

Figure 6:
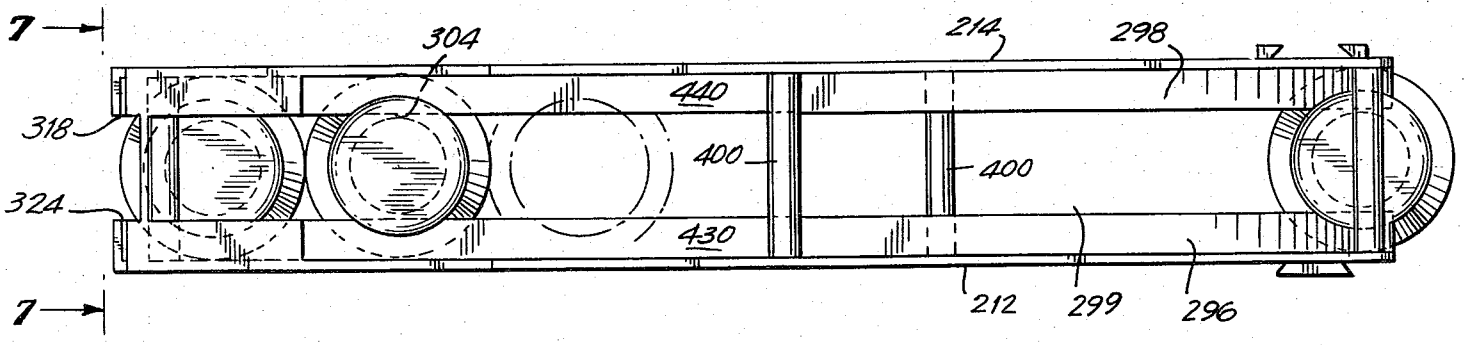
FIG. 6 is a top plan view of a modified embodiment of the invention.
Figure 10:
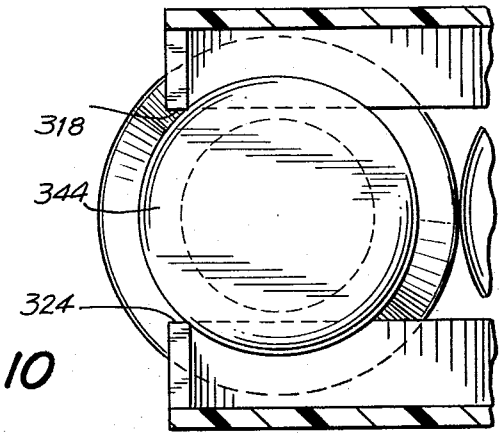
FIG. 10 is an enlarged cross-sectional fragmentary view taken along the line 10—10 of FIG. 8.
Figure 8:
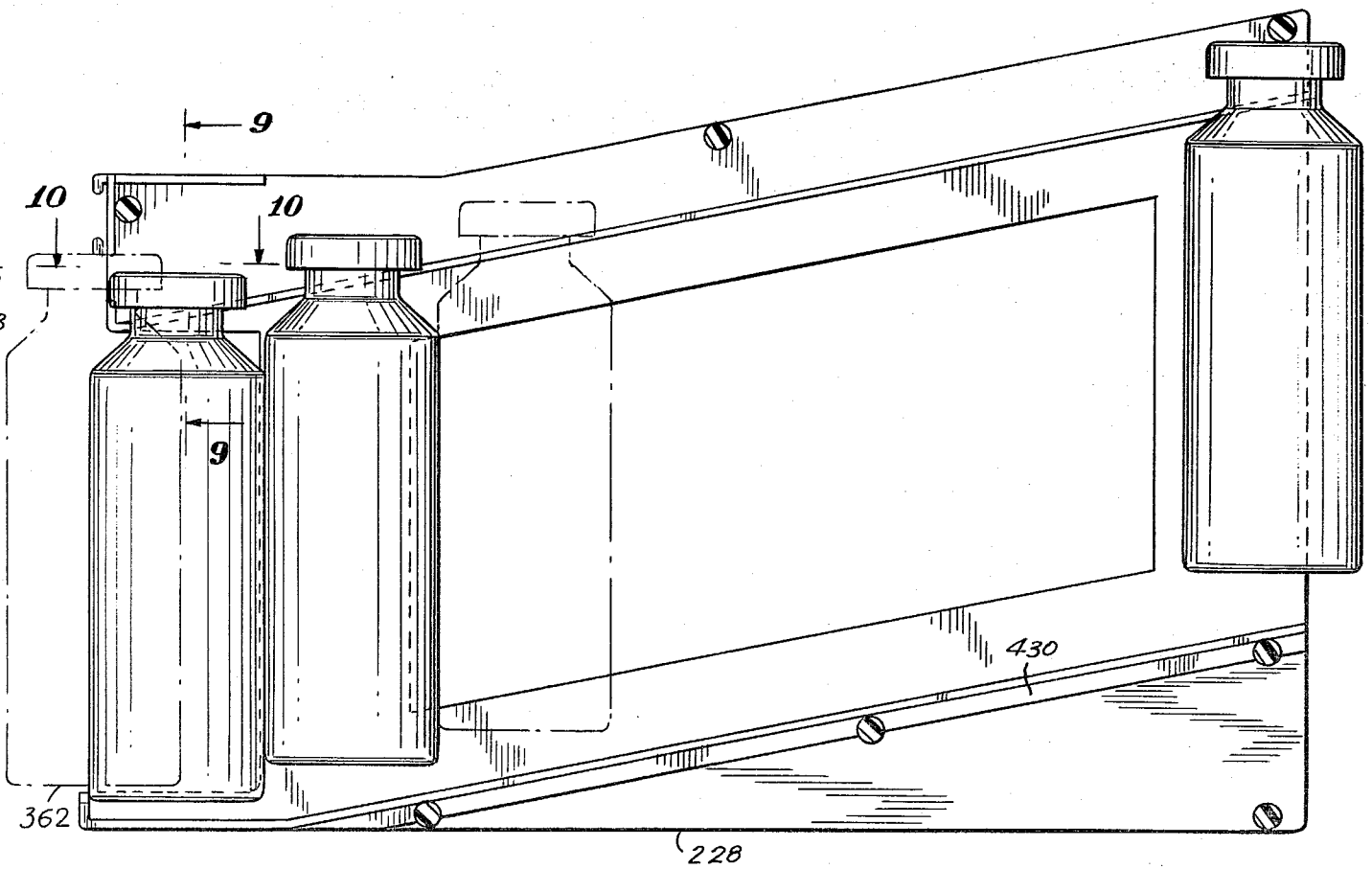
FIG. 8 is a cross-sectional view taken along the line 8—8 of FIG. 7.
Figure 7:
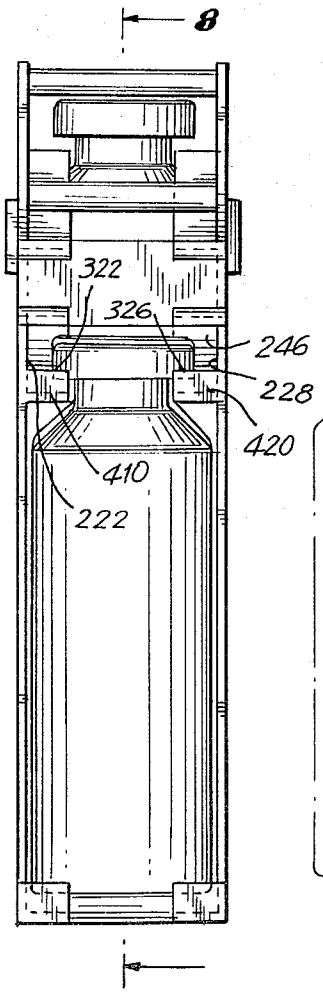
FIG. 7 is a rear elevational view taken along the line 7—7 of FIG. 6.

As can best be seen in FIGS. 6–8, the unit is defined by side walls 214, 222, held together by joinder posts 400. The unit further consists of shoulders 296, 298, which extend all the way to the rear of the unit. There is no back wall and there is no front wall. At the base of the shoulders, there are stop members 410, 420, which are defined by leading edges 318, 324, forming a first channel 344 which is the same width as channel 299.

Figure 9:
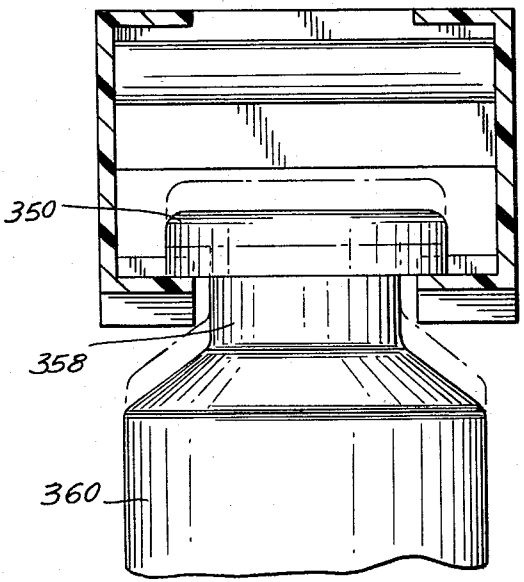
FIG. 9 is an enlarged fragmentary cross-sectional view taken along the line 9—9 of FIG. 8.

There is a lower underlying series of shoulders 430, 440 which are well below the bottom edge 362 of the bottle, but are in position to cushion the bottle should it fall off the upper shoulders. In the well known manner, bottles are placed into the rear of this unit. This unit is designed for bottles in which the widest portion of the upper portion of the bottle is the cap, such as is common for bottles containing alcoholic beverages. The bottle is inserted through the rear and by gravity it slides down the shoulders to 296, 298, until it reaches the front stops 410, 420. The height of the leading edges 318, 324 is less than the height of the neck 358 of the bottle. As best seen in FIG. 9, when the bottle is lifted upwardly, the bottle cap 350 will clear the intermediate shoulders 322, 326, and the bottle may be moved forwardly and out of engagement with the unit. In similar fashion to the preferred embodiment, the remaining bottles in line will move forwardly by gravity until the bottle behind the removed bottle will occupy its place in the front of the line. This unit is designed for a single compartment and is much longer to accommodate the usually longer liquor bottles.

While the preferred embodiment has been discussed with respect to a specific bottle carrying product manufactured by Clairol, Inc., and the modified embodiment has been described with respect to liquor bottles, it is obvious that these are non-limiting features of the invention and the invention may be utilized with any type of product container in which the product may be hung by an upper portion and capable of sliding forwardly and downwardly via gravity.

What is claimed is:

1. A gravity feed combined display and storage unit for product containers having upper necks with closure means which comprises:

said unit having support means;

at least two divider members secured to and sloping downwardly towards the display portion of said support means;

each divider member having a shoulder extending outwardly towards the shoulder of said other divider member and spaced therefrom, forming a channel whose width is greater than the width of the container neck, but less than the greatest diameter of either a portion of the neck or closure means;

the upper portion of the divider members and the adjacent portion of said unit having means to allow placement of containers on said shoulders, said shoulders always positioned at a height sufficient so that said product container always hangs free and clear; and the lower portion of said divider members terminating at bottle stop means secured thereto, the side edges of said stop means forming a stop channel, said stop channel being a continuation of and extending in a substantially acute upwardly direction from said channel, the height of said stop channel being at least slightly less than the height of the neck between the points of greatest diameter associated with the neck or closure means, an upper portion of said stop channel having a width greater than the greatest diameter of either said neck portion or said closure means whereby, lifting said product container into the upper portion of said stop channel will allow said product to be removed from restraint behind said stop means.

2. The invention according to claim 1, said support means having a bottle catch member secured at the bottom thereto, said catch member including receptacle means to support and, if necessary, interrupt the fall of a product container should it be dropped through the unit.

3. The invention according to claim 1, said unit including a storage receptacle member secured to the front of said support means at the lower end thereof, so that should a product container be opened and its contents partially used, the partially used container may be temporarily stored in the front of said unit until the contents are completely used.

4. The invention according to claim 1, said shoulders having an engagement area approximate the inner edges thereof, said edges facing and spaced from each other, said bottle having an annular bead on the upper portion of said neck, said engagement area engaging the lower portion of said bead.

5. The invention according to claim 1, said bottles having a cap and the engagement area of shoulders engaging the outer under portion of said cap.

6. The invention according to claim 1, wherein there are a plurality of units.

* * * * *